United States Patent [19]

Stepanenko et al.

[11] Patent Number: 5,001,918

[45] Date of Patent: Mar. 26, 1991

[54] METHOD AND APPARATUS FOR MAKING BLANKS OF A PROFILE VARYING LENGTHWISE

[76] Inventors: Alexandr V. Stepanenko, Surganova. 40. kv. 25.; Vladimir A. Korol, Leninsky prospekt; Georgy A. Isaevich, ulitsa Angarskaya, 13, korpus 2, kv. 22; Alexandr P. Grechenko, ulitsa Antonovskaya, 32. kv. 71; Sergei S. Benedis, 2 pereulok Bagrationa, 19, kv. 64; Stanislav S. Poplavsky, ulitsa Russiyanova, 44,kv.13; Igor M. Shimanovich, ulitsa Vostochnaya, 22 Korpus 1, kv. 5; Vitaly L. Markhasin, ulitsa Kommunisticheskaya, 44, kv. 2, all of Minsk, U.S.S.R.

[21] Appl. No.: 348,494

[22] PCT Filed: Jul. 29, 1988

[86] PCT No.: PCT/SU88/00155

§ 371 Date: Apr. 12, 1989

§ 102(e) Date: Apr. 12, 1989

[87] PCT Pub. No.: WO89/00899

PCT Pub. Date: Feb. 9, 1989

[30] Foreign Application Priority Data

Nov. 4, 1987 [SU] U.S.S.R. ..... 4320422
Dec. 22, 1987 [SU] U.S.S.R. ..... 4340834

[51] Int. Cl.[5] ..... B21D 7/04

[52] U.S. Cl. ..... 72/133; 72/134; 72/212; 72/213; 72/220

[58] Field of Search ..... 72/133, 134, 212, 213, 72/240, 426, 220

[56] References Cited

U.S. PATENT DOCUMENTS

| | | | |
|---|---|---|---|
| 1,047,167 | 12/1912 | Carlson | 72/213 |
| 2,647,422 | 8/1953 | Horn | 72/212 |
| 2,775,152 | 12/1956 | Krause | 72/240 |
| 2,918,101 | 12/1959 | Riker | 72/213 |
| 3,457,759 | 7/1969 | Doerr et al. | 72/213 |
| 3,490,261 | 1/1970 | Izett | 72/240 |
| 3,820,373 | 6/1974 | Shiguma et al. | 72/185 |

FOREIGN PATENT DOCUMENTS

| | | | |
|---|---|---|---|
| 1128591 | 1/1957 | France | 72/213 |
| 804079 | 2/1981 | U.S.S.R. . | |
| 1075880 | 7/1967 | United Kingdom | 72/212 |

OTHER PUBLICATIONS

I. L. Perlin et al., "Teoriya Volochenia", 1971, Metallurgia, (Moscow), see pp. 72, Fig. 55.

V. P. Severdenko et al., "Prokatka S Malymi Obzhatiyami", 1968, Nauka I Tekhnika, (Minsk), see pp. 176–177.

Spravochnik "Prokatnoe Proizvodstvo", vol. 1, 1962, Metallurgizdat, (Moscow), see p. 464, FIG. 25.

*Primary Examiner*—Lowell A. Larson
*Assistant Examiner*—Thomas C. Schoeffler
*Attorney, Agent, or Firm*—Burgess, Ryan and Wayne

[57] ABSTRACT

A method for making blanks of a profile varying lengthwise, such as few-leaf springs involves placing a heated billet (1) on a sizing former (2) and feeding it to a deformation zone for forming a product of a preset profile which is carried out from the middle part (3) of the billet simultaneously towards its ends (4,5) thereof to form its runs by drawing or rolling. In an apparatus for carrying out this method, a forming means is provided with a constant-size groove (6) so that the billet runs are formed simultaneously during passage therethrough, or has a pair of carriages supporting non-driven rolls and moving in the opposite directions.

13 Claims, 9 Drawing Sheets

METHOD AND APPARATUS FOR MAKING BLANKS OF A PROFILE VARYING LENGTHWISE

TECHNICAL FIELD

The invention relates to the metal press working, and more specifically, it deals with a method and apparatus for making blanks of a profile varying lengthwise. The invention may be most advantageously used for making blanks of few-leaf springs for automobile vehicles, tractors and railway vehicles.

BACKGROUND OF THE INVENTION

Rolling strips of a profile varying lengthwise is one of the most complicated processes of metal press working, the difficulties mainly arising because of the need to produce blanks with accurate dimensions, especially as regards height and width of the section at various points lengthwise of the blank in view of a transient process of metal deformation. With transient rolling processes which are characteristic of the manufacture of strips of a profile varying lengthwise, forward slip and spreading of metal are variables which vary over a broad range not only depending on the taper angle, but also on the character of a change (decrease or increase) in reduction. All these factors cause the need for maximum possible stabilization of metal rolling conditions.

In addition, stringent requirements are imposed upon blanks for few-leaf springs as regards identity of properties over the whole length and presence of open metal texture along the longitudinal axis of the blank which have a special effect on reliability and durability.

Known in the art is a method for making strips of a profile varying lengthwise, in particular, blanks of few-leaf springs, comprising heating a billet, preliminarily reducing it in wedge-shaped dies edgewise on both ends of the billet on a movable table and rolling a varying profile first of one run of the billet during the forward stroke of the table and then the other run during the return stroke of the table between two driven rolls, the upper roll being vertically reciprocatable.

An apparatus for carrying out this method comprises wedge-shaped dies for preliminarily reducing the billet edgewise on both ends, a movable table for supporting the billet, a roll stand having a pair of driven workrolls, the upper roll being reciprocatable, and a means for moving the upper roll.

However, with this method and apparatus for making strips of a profile varying lengthwise, in particular, blanks of few-leaf springs, it is necessary to have sophisticated electronic servo systems so as to ensure accurate dimensions of the strip, especially its thickness because of an inadequate rigidity of the means for vertically moving the upper roll. The provision of the means for moving the upper roll and for supporting the billet on the table substantially complicates design of the roll stand. The need to perform two rolling operations (during forward and return strokes of the table) to form a two-sided taper on the strip prolongs the production process. In addition, the runs of the spring may be of different properties with respect to its central zone because they are rolled consecutively and generally under different temperature conditions.

Also known in the art is a method for making blanks of a profile varying lengthwise, in particular, blanks of few-leaf springs, comprising heating a billet, placing it on a groove of a movable sizing former, feeding the former carrying the billet to a deformation zone, and rolling the billet by driven rolls.

According to the prior art method, a blank of a profile varying lengthwise is manufactured in a single pass in one direction on a sizing former having a groove configured to correspond to the shape of the blank formed after the rolling. To compensate for a spread occurring in rolling a varying profile with this method, the heated billet is preliminarily reduced widthwise in vertical driven rolls before placing on the sizing former.

It is, however, difficult to ensure accurate dimensions of the finished product with this method because of forward slip and spread of metal which vary depending on the amount of reduction. As the rolling process occurs in one direction only and begins with maximum reductions, the metal volume redistributed lengthwise of the billet in the direction from one end of the blank to the other substantially increases to cause a substantial growth of specific pressures upon the rolls and their elastic recoil. This calls for the need to synchronize linear velocities of the rolls and former which can be made by providing auxiliary means so as to complicate the process and make it more expensive.

In addition, both rolling of the billet along the whole length and separate consecutive rolling of its runs cause non-uniformity of properties of the finished product because it is not possible to maintain constant temperature conditions of the rolling and ensure high output.

Therefore, the analysis of prior art methods and apparatuses for making blanks of a profile varying lengthwise shows that these methods and apparatuses are rather complicated and difficult in manufacture; they call for the employment of unwieldy equipment. The use of various designs of the rolls, screwdowns for adjusting the nip between rolls, and the like substantially complicates the process, and employment of electronic servo systems for ensuring accurate dimensions materially raise the cost of equipment and restricts the field of its commercial application.

SUMMARY OF THE INVENTION

The invention is based on the problem of providing a method and apparatus for making blanks of a profile varying lengthwise which are capable of stabilizing metal deformation process, ensuring accurate dimensions of the profile and identical methanical properties lengthwise of the blank run owing to a reduction in a specific metal pressure against the rolls.

This problem is solved by a method for making blanks of a profile varying lengthwise, comprising heating a billet, placing it on a sizing former and feeding the former carrying the billet to a deformation zone for making products of a predetermined profile, according to the invention, the heated billet is deformed on the sizing former simultaneously from the middle portion of the billet towards the ends thereof. It is preferred that deformation of the heated billet on the sizing former be carried out in one direction by feeding the former with the blank moving with its middle part through a groove of a constant size using the former which has its sizing faces on either side symmetrical with respect to the longitudinal axis of the former, each face being as long as the length of the product between its middle portion and the end.

Since deformation of the heated billet in the method according to the invention is carried out on the sizing former from the middle portion of the billet towards the ends thereof simultaneously in one direction by feeding the former carrying the billet with the billet middle part moving through the groove of a constant size, both runs of the billet are rolled under identical conditions (at one and the same temperature and degree of reduction), whereby properties of both runs of the spring will be identical after the rolling. The time for moving the rolls in the method according to the invention is twice as short as with the prior art so that output increases.

Deformation of the heated billet on the sizing former may be carried out by rolling with at least one pair of non-driven rolls, the heated billet being put astride the sizing former during feeding thereof to the deformation zone in such a manner that the middle part of the billet is positioned opposite to the roll groove and during the rolling the rolls rolling over the bent billet form its runs to conform to the configuration of the sizing face of the former and, when the rolling is completed, the billet removed from the former is unbent to impart a preset shape thereto. This procedure ensures rolling of the blank strip with the front tension so as to contribute to stabilization of the transient deformation process, i.e., owing to a change in the zone of deformation, there is no forward metal slip over the former, the metal pressure against the rolls is lowered thereby lowering elastic recoil of the rolls, hence enhancing accuracy of the strip thickwise.

Moreover, it is known that tensioning a strip during rolling lowers spread so that the method according to the invention makes it possible to ensure more accurate dimensions widthwise of the strip as well, whereby there is no need to synchronize linear velocities of the roll and former.

According to one embodiment of the invention, rolling is carried out with stepwise deformation, with small individual reductions. This facility ensures a substantial reduction of energy consumption and forces and, bearing in mind that the stepwise deformation substantially lowers transverse deformation and increases the longitudinal deformation, stresses widthwise of the billet decrease during rolling so as to contribute to the manufacture of high-grade products owing to reduction of strip camber and more accurate dimensions widthwise of the strip. In addition, a much smaller spread and a more intensive longitudinal deformation with the stepwise rolling ensure a more open texture of rolled products, and a more intensive deformation of the surface layers of metal owing to a repeated action of the tool upon the metal contributes to the appearance of residual compressive stresses in the surface layers, which enhance fatigue strength of the spring and their durability.

The billet may be deformed on the sizing former by drawing through a die, the heated billet being put astride the former during its feeding to the deformation zone in such a manner that the middle part of the billet be positioned opposite to the die aperture, the working face thereof cooperating during drawing with the bent billet to shape its runs in accordance with the shape of the sizing face of the former and after completion of the drawing, the billet removed from the former is unbent to impart a preset shape to it.

In this embodiment of the method, rolling-contact friction in the deformation zone is replaced by sliding-contact fraction over the entire contact surface so as to provide conditions for the development of a more intensive shear deformation which results in a substantial reduction of metal resistance to deformation, i.e. in lowering of energy consumption and reduction of forces, and high-grade products can be produced owing to a lower strip camber because of balanced longitudinal stresses widthwise of the strip. In addition, a more intensive shear deformation during rolling ensures a more intensive shear deformation during rolling ensures a more uniform finegrained metal structure which, in turn, contributes to enhancement of strength characteristics of the finished product.

According to one embodiment of the invention, deformation of the billet from its middle portion towards the ends thereof may be carried out simultaneously in the mutually opposite directions by rolling on a stationary former by at least two non-driven rolls which are moved along the former in the mutually opposite directions. This procedure ensures the manufacture of a finished product with identical properties of both runs as both runs of the billet are rolled simultaneously under identical conditions (with one and the same temperature and degree of reduction). When the rolls move in the opposite directions away from the transverse axis of the former, tensile stresses develop in the billet zone between the rolls to lower metal pressure against the rolls so as to contribute to more accurate dimensions of the finished product. As the time for moving the rolls in this method is twice as short as with the prior art method, productivity of the process increases.

The method for making blanks of a profile varying lengthwise is carried out by means of an apparatus comprising a bed, a sizing former, a forming unit and a means for feeding the former carrying the billet to the forming unit, wherein, according to the invention, the forming unit is installed stationary on the bed and has a groove of a constant size, the former being installed coaxially with the groove and having sizing faces provided on either side thereof symmetrically with respect to the longitudinal axis of the former, each sizing face being as long as the length of the product between its middle part and the end thereof, a pair of billet guide rolls being provided between the former and the forming unit, the guide rolls being positioned symmetrically with respect to the longitudinal axis of the former, and an abutment being provided on the bed which is spaced from the longitudinal axis of the former at a distance equal to one half of the billet length. The forming unit may have at least one pair of non-driven rolls.

This structural embodiment of the forming unit substantially simplifies design of the apparatus as a whole because there is no need to provide auxiliary vertical rolls for preliminary reduction of the heat billet widthwise. Also there is no need to provide a means for driving the workrolls, a means for moving one of the rolls in vertical direction, a means for synchronizing linear velocity of the rolls with the velocity of the sizing former, whereby the apparatus design is greatly simplified; the apparatus is more compact and consumes less energy.

The provision of the guide rolls for placing the billet on the former and abutment for correctly positioning the billet to ensure accurate dimensions lengthwise makes it possible to dispense with complicated means for placing the billet on the former and for ensuring its accurate orientation before rolling and ensures the possibility of cutting-in the whole apparatus in an automatic production line for the manufacture of few-leaf springs without disrupting continuity of the production process.

The forming unit may be made in the form of a known per se planetary rolling mill in which workrolls having rims are mounted for free rotation in cages of the guide rolls, the sizing faces of the former being in the form of concave curves with a center of each curve, taking into account the varying thickness of the blank run profile being produced, being located on the axis of rotation of the respective guide roll. This facility ensures a material increase in the rate of deformation which depends not only on velocity of movement of the sizing former, but also on speed of rotation of support rolls of the planetary mill so as to enhance productivity of the apparatus.

The design of the former according to the invention, in which the sizing faces are in the form of concave curves, features a greater rigidity owing to greater transverse dimensions and shorter length which, in the end of the day, allows an accurate profile of the finished product to be obtained.

The forming unit may be made in the form of a die having an aperture of an I-section configuration, with pressure bars mounted in the grooves for engaging shoulders of the former so as to limit its sizing faces. This forming unit features a high rigidity owing to the engagement of the pressure bars with the former shoulders during the former movement and owing to a reduction of the number of clearances between members of the forming unit so as to provide for a more accurate profile of the finished product.

In one embodiment of the invention, the apparatus may have a plurality of formers having shoulders, and a means for feeding the formers to the forming unit may be made in the form of a revolving faceplate, the formers being mounted in series on the faceplate, the sizing faces of each former being in the form of curves, the forming unit comprising a rolling stand having vertical non-driven rolls having their axes running in parallel with the axis of rotation of the faceplate and located on concentrical circles, the centers of the circles coinciding with the center of rotation of the faceplate.

The provision of additional formers in the apparatus according to the invention and movement of the formers along a circular path ensure the possibility of rolling of several billets (in a number corresponding to the number of the formers) continuously, the time for return motions of the working members of the apparatus being reduced and the speed of their movement increased so as to substantially increase output.

The provision of the additional formers on the revolving faceplate reduces the time for readjustment of the apparatus, and in case of blanks for few-leaf springs having thickness of their central portions differing within the range of up to 4 mm and having the profile varying lengthwise according to a parabolic law, makes it possible to roll several sizes without readjustment. The absence of reciprocations of working members substantially lowers impact loads, allows for smooth operation of the apparatus, enhances its reliability and durability.

In addition, the lay-out of the apparatus according to the invention, with the working mechanisms positioned along a radius on a cylindrical base substantially reduces the production area.

In an apparatus for carrying out the method for making blanks in which deformation of the billet from the middle portion thereof towards the ends thereof is carried out simultaneously in the mutually opposite directions, and which comprises a bed, a sizing former, a forming unit, and a means for feeding the former carrying the billet to the forming unit, according to the invention, the former is made with shoulders defining a groove for the billet, the length of the groove corresponding to the length of the finished product, and the forming unit comprises non-driven rolls and at least two driven carriages carrying said rolls and moved along the axis of the former in the mutually opposite directions away from the middle part of the former.

It is preferred that guides be provided in the apparatus and that the former be mounted on the guides for movement perpendicularly with respect to the rolling path, the guides, in combination with the sizing former, defining pairs of wedges having identical angles of pitch and the vertexes facing in the opposite directions, an abutment plate being mounted at the ends of the guides on the side opposite to the means for feeding the former, the abutment plate having a means for pressing the billet against the former and functioning as one of the former shoulders.

The provision of the carriages moving in the opposite directions and having non-driven rolls mounted thereon allows the rolling cycle time to be reduced owing to a reduction of travel distance of each of the rolls and makes it possible to dispense with the need to synchronize linear velocity of the rolls with the velocity of the former.

The provision of the sizing former and guides in the form of pairs of wedges having identical angles of pitch and the vertexes facing in the opposite directions, and the transverse movement of the sizing former with respect to the rolling path facilitates placing the billet on, and removing it from the former and also allows the former carrying the billet to be fed to the deformation zone with prepressing of the billet against the former.

The means for pressing the billet against the former is preferably made in the form of a spring-biased bracket mounted on the abutment plate for vertical movement in parallel with the abutment plate and a wedge-shaped pushrod mounted on the end face of the sizing former, the abutment plate and the spring-biased bracket having openings, the pushrod passing through these openings to engage the bracket and to move it.

This design of the means for pressing the billet is simple it does not call for the provision of an auxiliary power drive and ensures a reliable holding of the billet against longitudinal displacement during rolling which is especially important initially when the degree of deformation and forces of friction between the billet and former are insignificant.

The carriages may have a common drive including an electric motor and screw pairs having their screws connected to the electric motors through a reduction gear and journalled in bearings of the bed uprights to extend in parallel with the longitudinal axis of the former, each of the screws having two equal parts with lefthand and righthand threads. This drive is simple in design and makes it possible to increase velocity of movement of the carriages supporting the rolls, hence, to increase the rate of metal deformation within a broad range which substantially reduces the rolling time.

Therefore, the method and apparatus according to the invention for making blanks of a profile varying lengthwise such as few-leaf springs ensure:

manufacture of a finished product of high quality owing to more accurate dimensions of the profile, formation of the desired metal texture and identity of mechanical properties over the whole length of the product;

stabilization of transient process of metal deformation owing to a lower metal pressure against the forming tools (rolls) and absence of forward metal slip under the action of the sizing former;

simplicity and reliability in operation, high output.

BRIEF DESCRIPTION OF DRAWINGS

The invention will now be described with reference to a detailed description of specific embodiments illustrated in the accompanying drawings, in which.

BEST MODE FOR CARRYING OUT THE INVENTION

A method for making blanks of a profile varying lengthwise such as blanks for few-leaf springs comprises heating a billet 1 (FIG. 1), which is carried out by an appropriate known method, placing the billet on a sizing former 2 and feeding the former 2 carrying the billet 1 to a deformation zone for producing a product of the desired profile.

Figure 1:
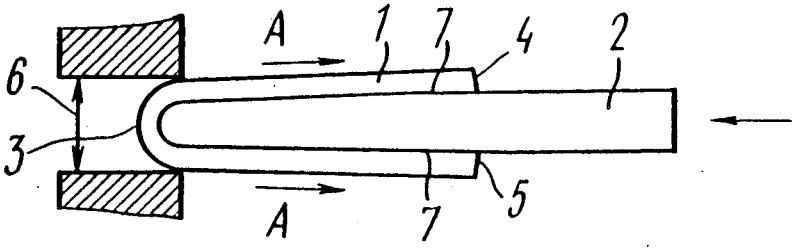
FIG. 1 shows deformation of a billet simultaneously in one and the same direction, according to the invention.
Figure 2:
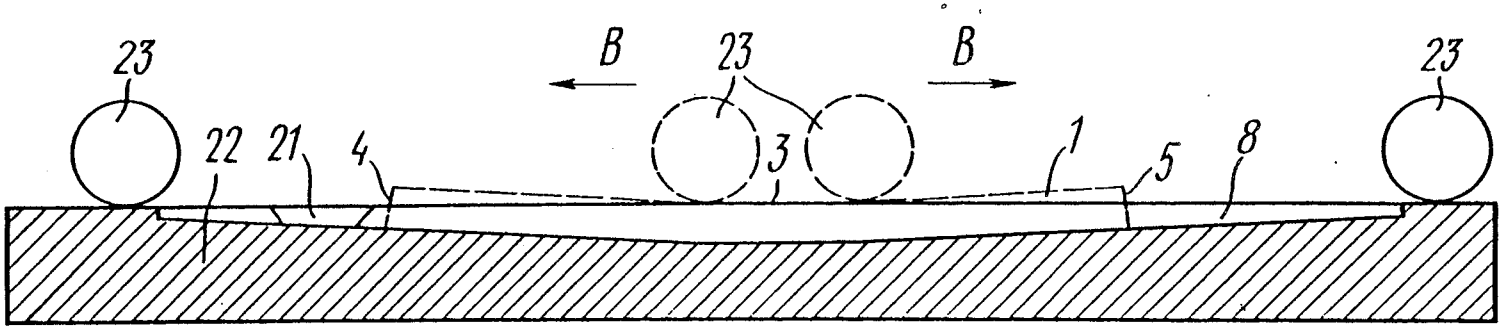
FIG. 2 shows deformation of a billet simultaneously in the mutually opposite directions, according to the invention.

The heated billet is formed on the sizing former in a direction from a middle portion 3 of the billet towards ends 4, 5 thereof simultaneously, deformation of the billet being carried out from its middle portion to the ends 4, 5 thereof either simultaneously in one and the same direction as shown by arrows A in FIG. 1 or simultaneously in the mutually opposite directions as shown by arrows B in FIG. 2.

The billet 1 is deformed from its middle portion 3 towards the ends 4, 5 thereof simultaneously in one and the same direction by feeding the former 2 (FIG. 1) carrying the billet 1 with its middle portion 3 through a groove 6 of a constant size, the former 2 having its sizing faces 7 (FIG. 3) provided on either side symmetrically with respect to the longitudinal axis 0-0 of the former 2, each face being of a length corresponding to a length "1" of a finished product 8 (FIG. 4) between its middle portion 3 and the end thereof, a curve defining the shape of the sizing faces 7 of the former 2 being similar to a curve defining a longitudinal profile 9 of the finished product 8.

The groove 6 of a constant size may be in the form of at least one pair of non-driven rolls 10 having rims 11 (FIG. 5, 6), and when the sizing former 2 is fed to the deformation zone, the heated billet 1 is put astride the former by means of guide rolls 12 in such a manner that the middle portion 3 of the billet 1 is positioned opposite to the groove of rolls 10 and the rolls 10 roll over the bent billet during rolling to form its runs, i.e. the ends 4, 5 to conform to the configuration of the sizinng faces 7 of the former 2. After the rolling, the billet removed from the former is unbent to impart to it the shape of the finished product 8 (FIG. 4) and is fed for further treatment in accordance with the manufacturing process.

Figure 4:
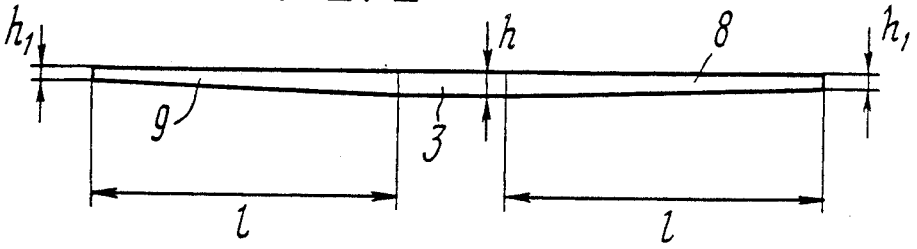
FIG. 4 is a finished product manufactured as shown in FIGS. 1, 2.
Figure 5:
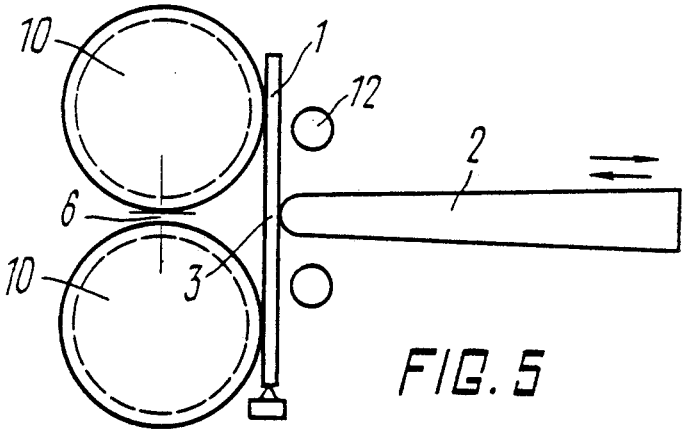
FIG. 5 shows position of a former and billet with respect to a forming unit.
Figure 6:
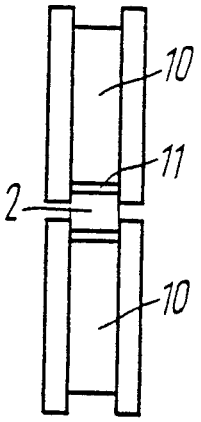
FIG. 6 shows position of a billet and former in the groove of a forming unit.
Figure 7:
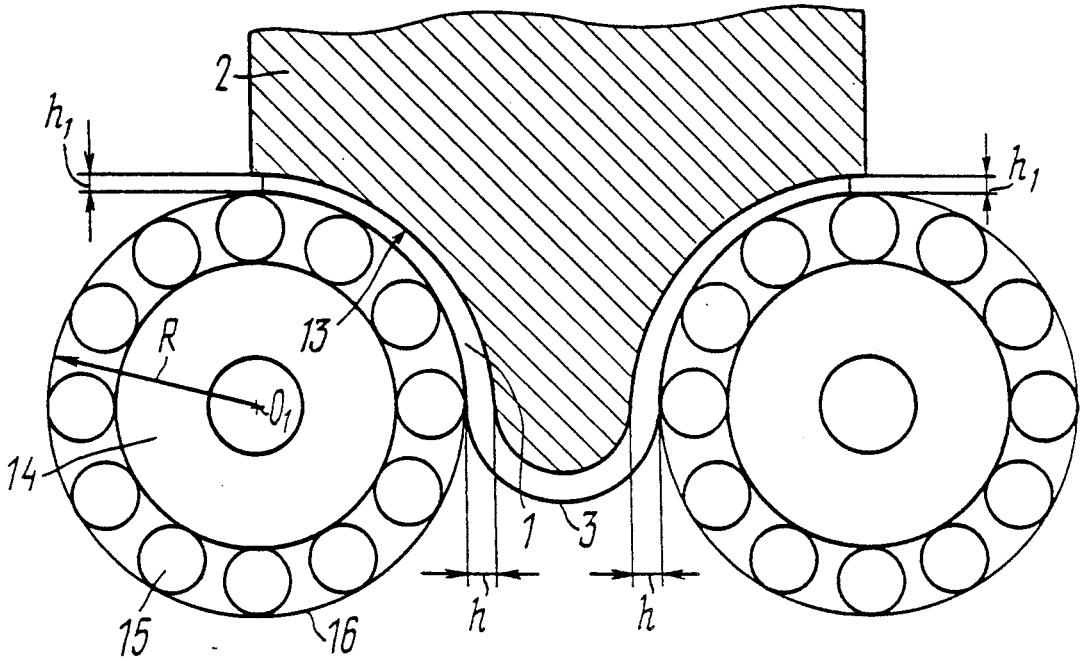
FIG. 7 shows deformation of a billet with stepwise deformation according to the invention.

In accordance with the embodiment shown in FIG. 7, rolling of the billet 1 is carried out with stepwise deformation with small individual reductions using a known per se planetary rolling mill, the use being made of the former 2 having sizing faces made in the form of concave curves 13 having a center $O_1$ of each curve, taking into account varying thickness of the runs of the finished product 8, located on an axis of rotation of a respective support roll 14 carrying a plurality of non-driven workrolls 15, the shape of the curves 13 being determined in a known manner taking into account radius R of a path 16 of generation of the billet by the workrolls 15 and varying thickness of the run between h and $h_1$ in the finished product 8 (FIG. 4). The billet is unbent after the rolling to impart the pre-set shape to it.

The billet 1 may be deformed on the sizing former 2 by drawing it through a die 17 (FIG. 8) or through a plurality of dies (not shown) having an aperture 18 which functions as the groove 6 of a constant size. When the sizing former 2 is fed to the deformation zone, the heated billet is put astride the former by means of guide rolls 19 in such a manner that the middle portion 3 of the billet is positioned opposite to the die aperture, the working faces 20 of the die 17 engaging the bent billet 1 during drawing to shape its run in accordance with the configuration of the sizing face of the former which is made as described above and as shown in FIG. 3. After the drawing, the billet removed from the former is unbent to impart the desired shape to it.

The billet 1 is deformed from the middle portion thereof to the ends thereof simultaneously in the mutually opposite directions as shown in FIG. 2 in the following manner.

The heated billet shown with dotted lines in FIG. 2 is placed into a groove 21 of the sizing former 22, the former 22 carrying the billet 1 is fed to the deformation zone and the billet is rolled by means of rolls 23. The billet 1 is rolled by means of a pair of the non-driven rolls on the stationary former 22 on the side of the exposed surface of the billet 1 from its middle portion 3 towards the ends 4, 5 thereof, the rolling being carried out simultaneously by moving the rolls 23 in the mutually opposite directions along the former 22 as shown by arrows B.

The former 22 carrying the billet is then removed from the deformation zone after the rolling, the finished product 8 is removed and fed for further processing.

An apparatus for carrying out the method shown in FIG. 1 comprises a bed 24 (FIG. 9, 10), a forming unit 25 having the groove 6 of a constant size, a former 2 being mounted coaxially therewith, a means 26 for feeding the former 2 carrying the billet 1 to a deformation zone 25, a means 27 for removing the rolled billet from the former 2, and a means 28 for unbending the billet.

Figure 3:
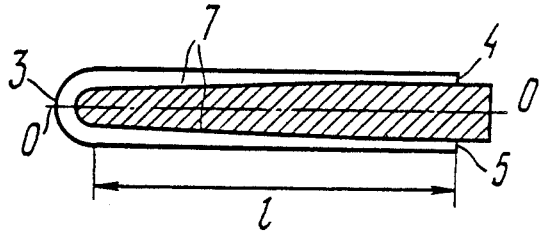
FIG. 3 shows a billet after deformation as shown in FIG. 1.

The sizing faces 7 of the former 2 are provided on either side as shown in FIG. 3 symmetrically with respect to the longitudinal axis of the former, each face being of a length corresponding to the length "1" of a run of the finished product 8 (FIG. 4) between its middle portion 3 and the ends 4, 5.

A pair of guide rolls 12 are provided between the former 2 and the forming unit 25 (FIG. 10) for placing the billet 1 and putting it astride the former 2 during its movement towards the deformation zone 25, the rolls being positioned symmetrically with respect to the longitudinal axis of the former.

The bed 24 has a limiting abutment 29 spaced from the longitudinal axis 0-0 of the former at a distance equal to one half of the length of the billet and designed for automatically placing each heated billet with its middle portion 3 aligned with the groove 6.

The means 26 for feeding the former 2 carrying the billet 1 to the deformation zone is in the form of a hydraulic cylinder 30 which is rigidly secured to the bed 24 and a carriage 31 movable along guides 32 of the bed 24. The carriage 31 is connected to a piston rod 33 of the hydraulic cylinder 30 and to the sizing former 2.

The means 27 (FIG. 9) for removing the rolled billet from the former 2 mounted on the bed downstream the forming unit 25 consists of vertical columns 34 and a plate 35 movable along these columns under the action of a hydraulic cylinder 36. The plate 35 carries pushrods 37 acting upon the billet during movement of the former carrying this billet under the means 27 as shown with dotted lines.

The means 28 for unbending the billet removed from the former consists of a clamping unit 38 for clamping the middle portion of the billet and a pair of power actuators 39 engageable with the runs of the bent billet.

The clamping unit 38 consists of a pressure shoe 40 (FIG. 11) reciprocatable along guides 41 secured to a plate 42 of the bed and driven by a piston rod of a hydraulic cylinder 43.

Figure 9:
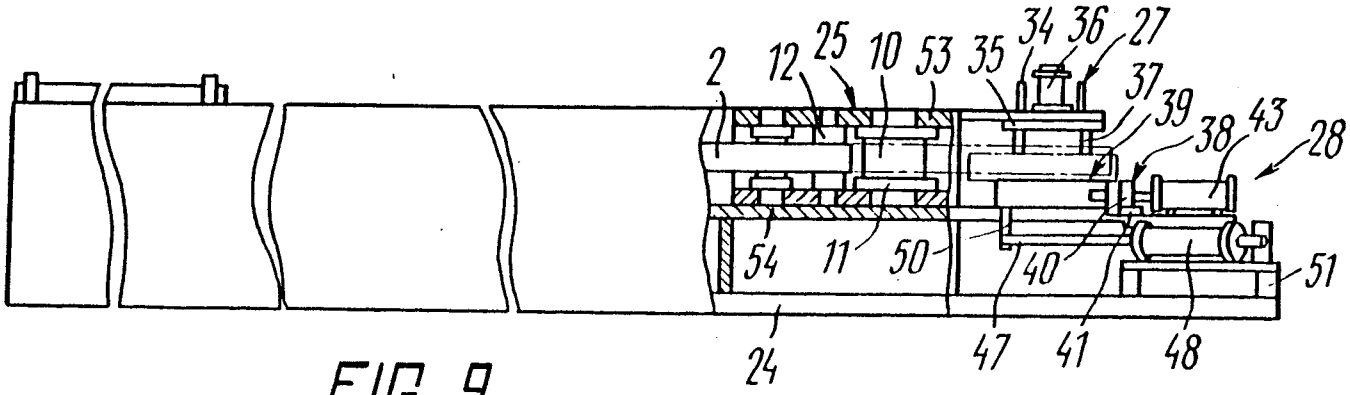
FIG. 9 is a general view of an apparatus for carrying out the method of FIG. 1 in a side elevation, according to the invention.

The power actuator 39 are in the form of levers 44 and 45 each having one arm put on a common fulcrum secured to the plate 42 rotatable with respect thereto, the other arms of the levers 44 and 45 being pivotally connected to piston rods 47 of hydraulic cylinders 48 (FIG. 9). To ensure uniform spacing of the levers 44 and 45 (FIG. 10) apart with respect to the fulcrum 46, a through arcuated slot is made in the plate 42 to receive pins 50. The pins 50 are designed to establish the pivotal connection of the levers 44 and 45 to the piston rods 47 of the hydraulic cylinders 48 and to transmit a traction force during their rotation about the fulcrum 46. The housing of the hydraulic cylinder 43 is rigidly secured to a frame 51 and the casings of the hydraulic cylinders 48 are pivotally connected to the frame 51 by means of pivot pins 52.

Figure 8:
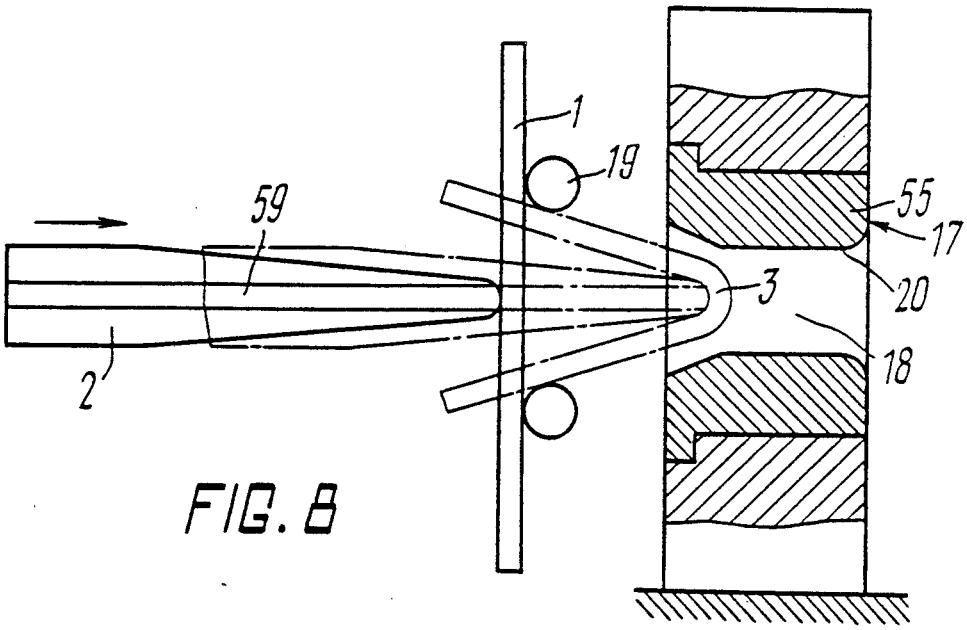
FIG. 8 shows position of a former with a billet in front of a die.
Figure 10:
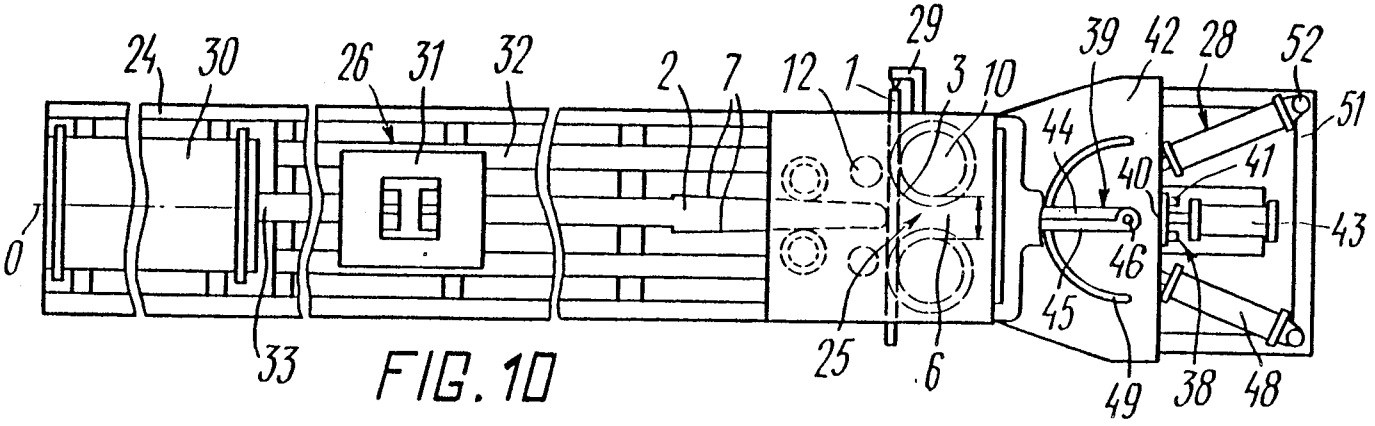
FIG. 10 is ditto of FIG. 9, a plan view.

The forming unit 25 in the apparatus according to the invention may have different embodiments, e.e., in the form of one or several pairs of non-driven rolls 10 as shown in FIGS. 9, 10, the die 17 as shown in FIG. 8, or the known per se planetary rolling mill as shown in FIG. 7.

The pair of non-driven rolls 10 (FIGS. 9, 10) or several pairs of non-driven rolls (not shown in the drawings) are made in the known per se manner and have the rims 11. The rolls 10 are mounted vertically with a constant nip between the rolls defining the groove 6 of a constant size and are mounted on an upper plate 53 and a lower plate 54 for free rotation under the action of forces of contact friction with the billet moved by the former 2.

Figure 12:
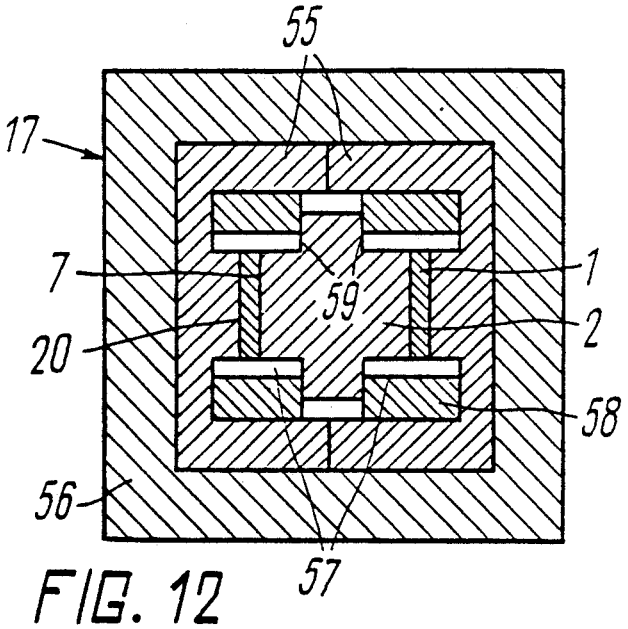
FIG. 12 shows position of a former with billet in a die aperture.

The forming unit shown in FIGS. 8, 12 comprises the die 17 consisting of two half-dies 55 mounted in a holder 56 rigidly secured to the bed. The aperture 18 of the die 17 is of an I-section configuration defined by the stationary working faces 20 and faces of grooves 57 receiving pressure bars 58 engageable with guides 59 of the former 2. During drawing, the runs of the billet are formed between the faces 20 and 7 of the half dies 55 and former 2, respectectly, the former guide faces 59 moving through the between the pressure bars 59 to engage them.

The apparatus functions in the following manner.

The billet 1 heated to the rolling temperature is moved by means of a driven roller table (not shown in FIGS. 9, 10) to the deformation zone 25 perpendicularly with respect to the direction of movement of the former 2 until the billet bears against the abutment 29 which is positioned in such a manner as to align the middle portion 3 of the billet with the groove 6 of a constant size as shown in FIGS. 1, 10.

It should be noted that if the forming unit 25 is made in the form of the non-driven rolls 10 (FIGS. 5, 10), the billet 1 is placed between the non-driven rolls 10 and the guide rolls 12, and if the forming unit 25 is made in the form of the die 17 (FIGS. 8, 12) the billet 1 is placed in front of the guide rolls 19 as shown in FIG. 8.

The carriage 31 rigidly secured to the former 2 is moved by the hydraulic cylinder 30 (FIG. 10) along the guides 32 of the bed 24 so as to move the former 2 towards the deformation zone 25.

During this movement, the former 2 engages the middle portion 3 of the billet 1 and starts moving it to the deformation zone 25. The runs of the billet between its middle portion 3 and the ends thereof are bent and placed on the sizing faces 7 of the former 2 by means of the rolls 12 (19) so that the billet is placed on the former as shown in FIG. 1 and is fed in this position through the groove 6 of a constant size.

During feeding of the former 2 carrying the bent billet 1 through the groove of a constant size, rolling (FIGS. 9, 10) or drawing (FIG. 8) occurs during which the runs of the bent billet are simultaneously deformed in one and the same direction, as shown in FIG. 1 between the middle portion 3 and the ends 4, 5 thereof in accordance with the shape of the sizing faces of the former, whereby the runs of the billet are shaped on the former during its passage through the deformation zone 25, the length of the runs corresponding to the length of the runs of the product as shown in FIG. 4.

Figure 11:
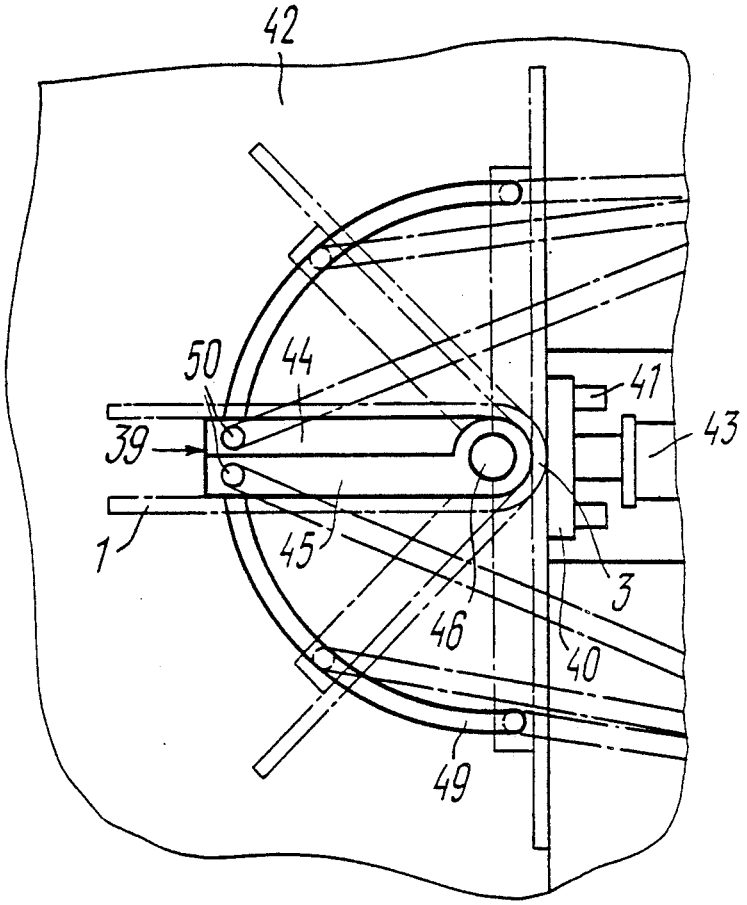
FIG. 11 shows position of a billet at various stages of its unbending.

The former 2 carrying the billet is positioned, after the passage through the deformation zone 25, under the means 27 for removing the billet (FIG. 9). The hydraulic cylinder 36 is actuated, and the piston rod thereof lowers the plate 35 along the columns 34. The pushrods 37 of the plate 35 engage the billet and, during further movement of the plate 35 down trip the billet off the former 2 to the plate 42 so that the closed levers 44 and 45 are surrounded by the runs of the bent billet 1 as shown in FIG. 11.

The middle portion 3 of the billet is pressed by the pressure shoe 40 against the levers 44 and 45 in the zone of the fulcrum 46 to ensure a stable position of the billet during unbending.

Then a signal for reversing the hydraulic cylinders 30 and 36 (FIGS. 9, 10) is sent to return the former 2 and plate 35 of the removing means to the initial position and to actuate the hydraulic cylinders 48. The piston rods 47 of the hydraulic cylinders 48 (FIG. 11) start being retracted to space the levers 44 and 45 apart with respect to the fulcrum 46 and, during movement of the pins 50 of the levers 44 and 45 in the arcuated slot 49, the latter act upon the runs of the billet to unbend it so as to impart to it the shape of the product shown in FIG. 4.

The unbent billet, which is now of the shape of the finished product, is then fed for further processing, another heated billet is fed to the deformation zone, and the abovedescribed cycle is repeated.

Figure 13:
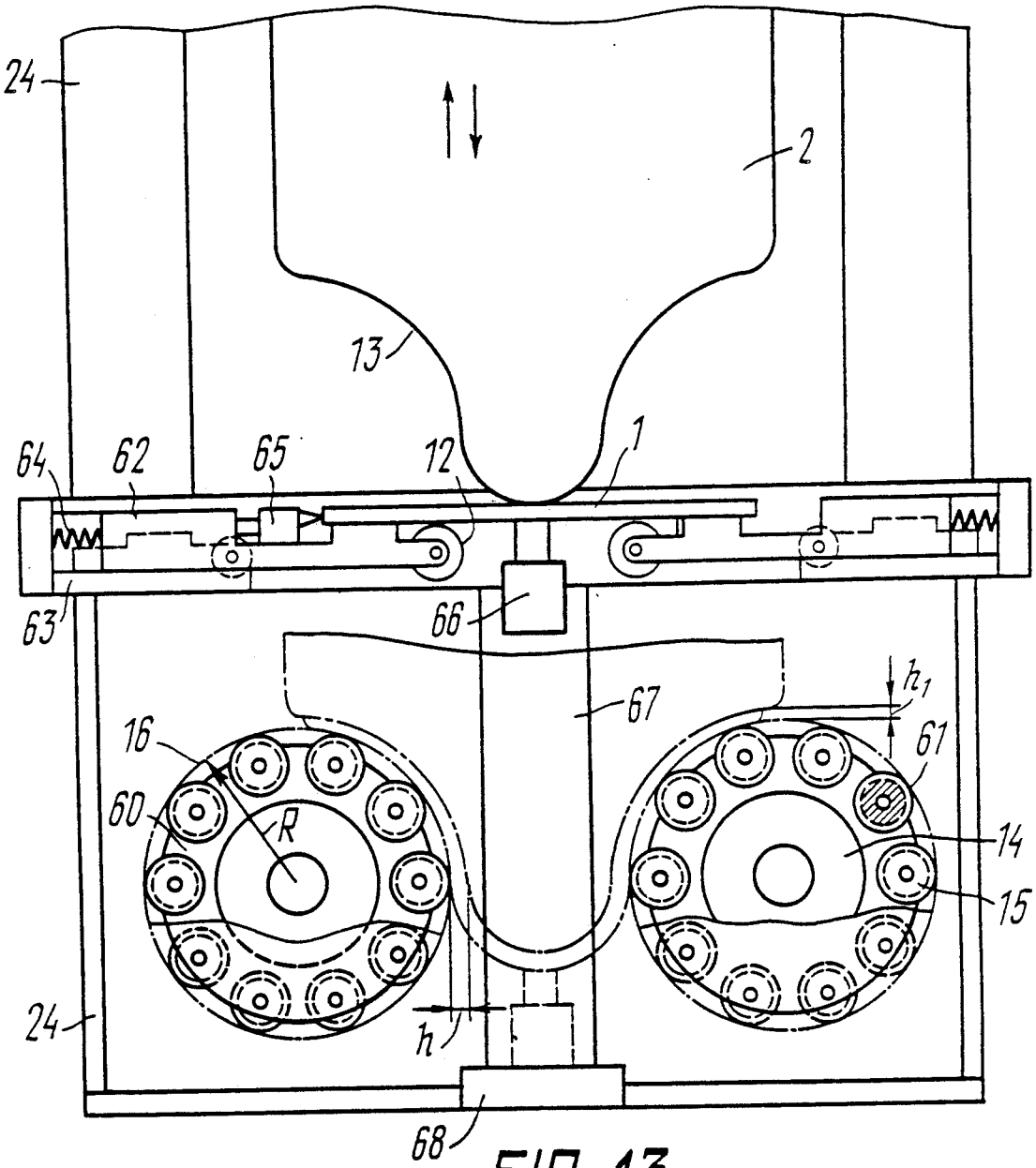
FIG. 13 is an embodiment of a part of an apparatus according to the invention for carrying out the method of FIG. 7.

The forming unit 25 shown in FIGS. 7,13 may be in the form of a known per se planetary rolling mill carrying out stepwise deformation of the billet runs with small individual reductions, consisting of a pair of driven support rolls 14 having cages receiving the workrolls 15 having rims.

In this embodiment of the forming unit 25, the former 2 is configured as shown in FIG. 7,13 and is formed by the two concave curves 13 as described above, which are symmetrical with respect to its longitudinal axis, and the guide rolls 12 are mounted on overhanging pads 62 moving along guides 63 of the bed 24 in a direction perpendicular to the direction of the movement of the former. The guides 63 are moved in one direction by the former 2 and in the other direction, by a spring 64 or by any other known power drive.

Depending on direction of feed of the heated billet, one of the pads 62 carries an abutment 65 designed for an automatic orientation of each heated billet symmetrically with respect to the longitudinal axis of the former.

The pressing of the billet 1 with its middle portion 3 against the former 2, there is provided a pressure shoe 66 which is movable together with the former 2 through the groove of the forming unit 25.

For that purpose, additional guides 67 are provided on the bed 24 as well as an abutment 68 designed for limiting stroke of the pressure shoe 66, setting-up the amount of movement of the former 2 and locking its limit position depending on minimum thickness $h_1$ of the rolled blank for a few-leaf spring.

As the former 2 of this type does not pass completely through the forming unit 25 together with the billet, the rolled billet is removed from the former after the former 2 has been moved back to the initial position or by the means 27 described above and provided upstream the unit 25.

The billet may be unbent individually or by any known means or by the means 28 positioned in the lower part of the bed.

Figure 14:
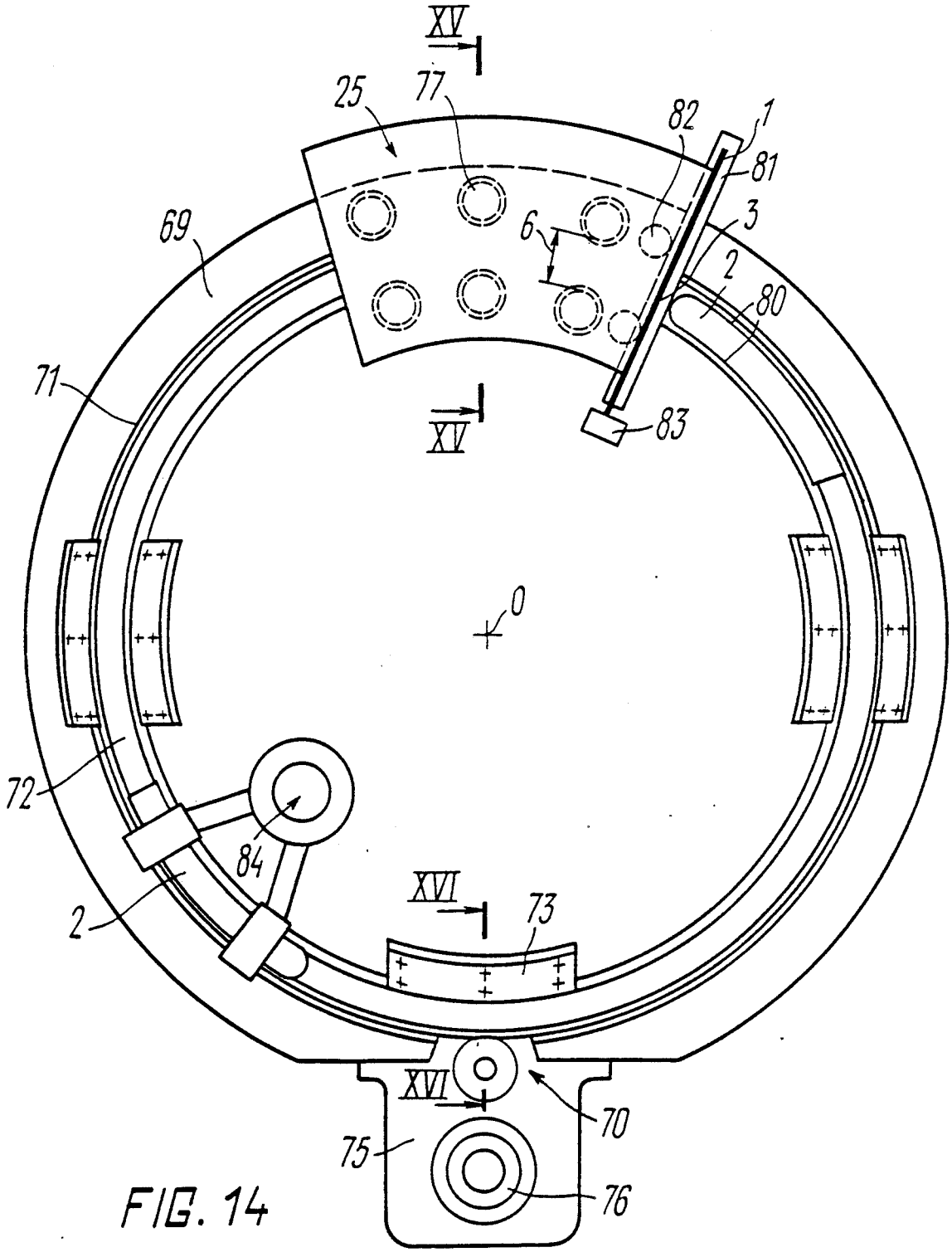
FIG. 14 is still another embodiment of an apparatus for forming blanks according to the invention, a plan view.

FIG. 14 shows still another embodiment of the apparatus for carrying out the method for making products of a profile varying lengthwise by deforming a heated billet between its middle portion and the ends thereof simultaneously in one and the same direction.

The apparatus comprises a plurality of sizing formers 2, a bed 69 and a means 70 for feeding the formers towards the forming unit 25. The bed 69 is in the form of a cylindrical base having a circular slot 71 in which there is mounted a revolving faceplate 72 supporting several formers 2, e.g. two formers 2.

The revolving faceplate 72 is held against vertical displacement by means of guide bars rigidly secured to the bed 69.

Figure 15:
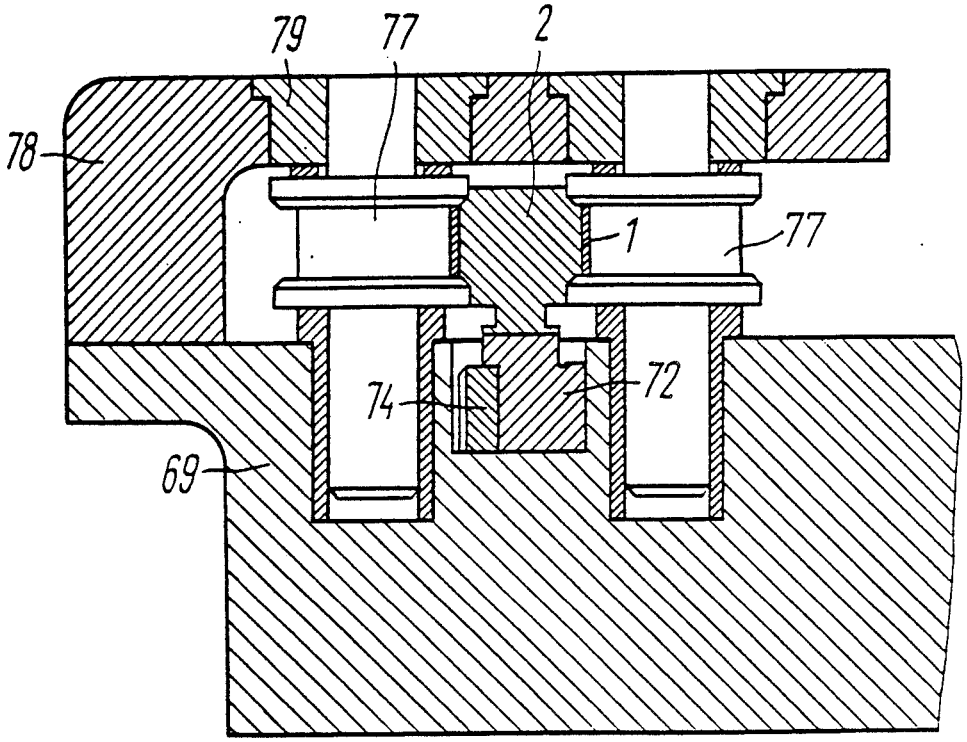
FIG. 15 is a sectional view taken along line XV—XV in FIG. 14.
Figure 16:
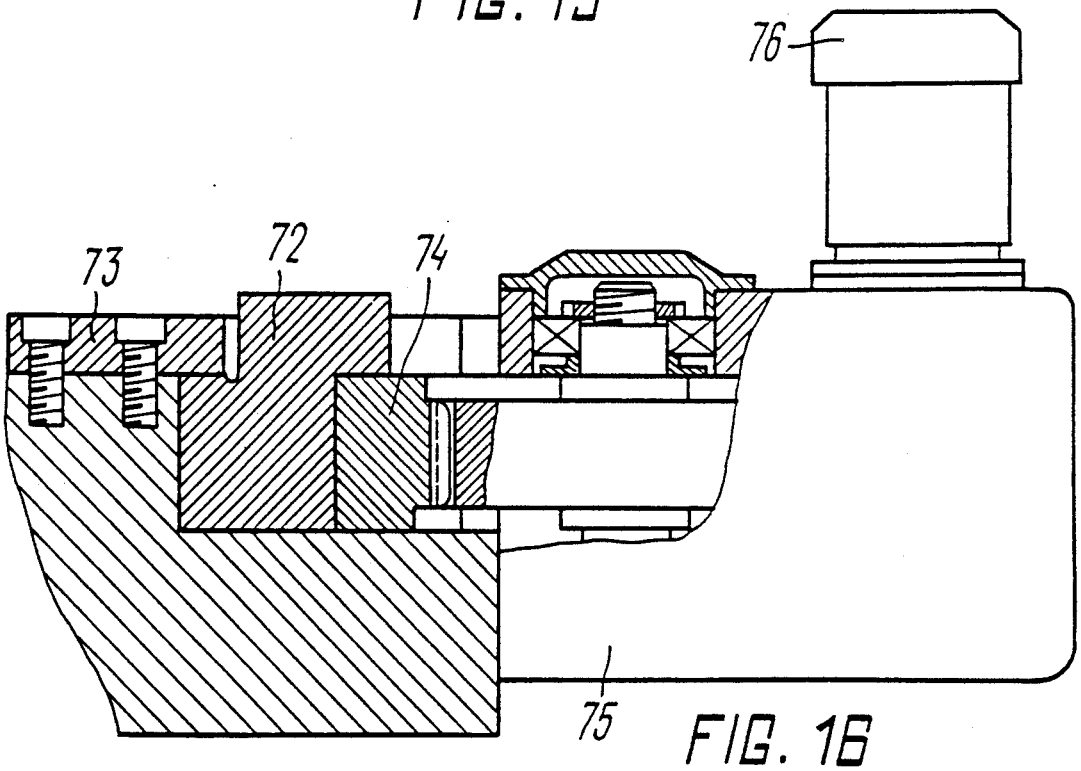
FIG. 16 is a sectional view taken along line XVI—XVI in FIG. 14.

The faceplate 72 (FIG. 15) is rotated by means of a circular toothed rack 74 rigidly secured to the faceplate 72, reduction gear 75 (FIG. 16) and electric motor 76.

The bed 69 (FIG. 14) carries the forming unit 25 in the form of a rolling stand having, e.g. three pairs of non-driven vertical rolls 77 with rims, each pair defining a groove 6 of a constant size.

The rolls 77 (FIG. 15) each have one end journalled directly in bores of the bed 69 and the other end journalled in an upper support plate 78 of the rolling stand, the upper support plate 78 having bushings functioning as sliding-contact bearings for receiving the rolls 77.

The axes of the non-driven rolls 77 run in parallel with one another and are positioned on concentric circles having their centers coinciding with the center 0 of rotation of the revolving faceplate 72 (FIG. 14).

The sizing faces of each former 2 are made in the form of curves 80 of a length corresponding to the length of runs of the finished product 8 (FIG. 4) between the middle portion 3 and the end thereof, and the shape of the curves is such that the runs of the rolled billet correspond to the shape of the finished product shown in FIG. 4 after unbending.

The apparatus also has guide bars 81 mounted on the bed along which the heated billet 1 is fed to the deformation zone 25 and one pair of guide rolls 82 installed upstream the rolls 77 andd designed for placing the billet 1 to put it astride the former 2 during movement of the former to the deformation zone. The guide rolls are journalled in the same manner as the rolls 77.

An abutment 83 is provided at the ends of the guide bars 81 for automatic orientation of each heated billet with respect to the longitudinal axis of the formers 2.

A means 84 for removing the rolled billets 2 is provided downstream the forming unit 25 on the bed 69, which is of any appropriate known type, e.g. in the form of an overhanging double-lever linkage ensuring removal of the billet from the former and its transfer to an unbending station for unbending carried out outside the apparatus at an individual station by the abovedescribed means or by any other appropriate known means.

The apparatus functions in the following manner. The billet 1 heated to the rolling temperature is fed by means of the driven roller table (not shown in FIG. 14) along guide bars 81 in the radial direction to the deformation zone until the billet bears against the abutment 83 mounted in such a manner as to ensure the alignment of the transverse axis of the billet 1 with the longitudinal axis of one of the formers 2 positioned upstream the forming unit 25.

Then the faceplate 72 driven by the electric motor 76, reduction gear 75 and circular toothed rack starts moving together with the formers 2 rigidly secured thereto in the slot 71. The former 2 engages the middle portion 3 of the billet 1 and starts moving it to the deformation zone as described above. The runs of the billet 1 are bent by the guide rolls 82 and are placed on the sizing faces of the former, and the former carrying the billet in this position is fed through the groove 6 of a constant size in the forming unit 25.

During feeding of the former 2 carrying the bent billet 1 through the groove of a constant size which is in the form of the vertical non-driven rolls 77, the runs of the bent billet are simultaneously deformed in one and the same direction as shown in FIG. 1 from the middle portion 3 towards the ends 4,5 to conform to the shape of the sizing face of the former, whereby runs of the billet are formed on the former after the passage through the deformation zone 25, the length of the runs corresponding to the length of the runs of the product 8 as shown in FIG. 4.

After the passage through the deformation zone 25, one former carrying the rolled billet is positioned under the removal means 84, and the other former, which is without a billet, is positioned upstream the deformation zone 25. At this moment a signal is fed to stop the faceplate 72.

The rolled billet is removed by the removal means 84 from the former 2 and is transferred to the unbending station as for unbending as described above or by any other appropriate known method.

At this moment another heated billet is fed along the roller table to the deformation zone 25 in which the second former is not available, and the abovedescribed cycle is repeated.

Figure 17:
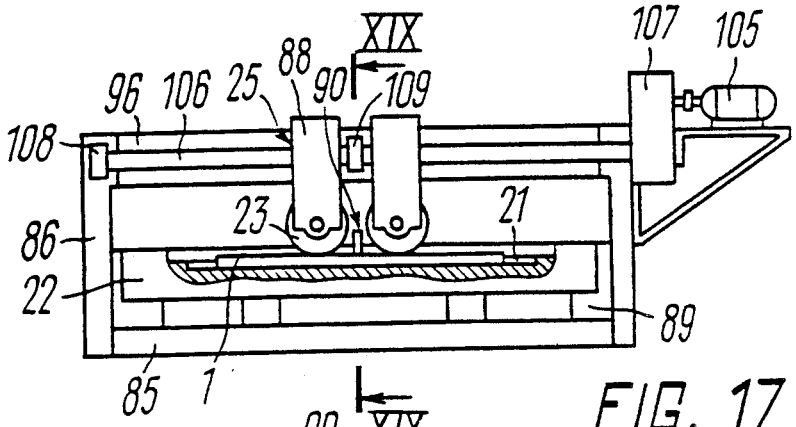
FIG. 17 is an apparatus for carrying out the method according to the invention of FIG. 2.
Figure 18:
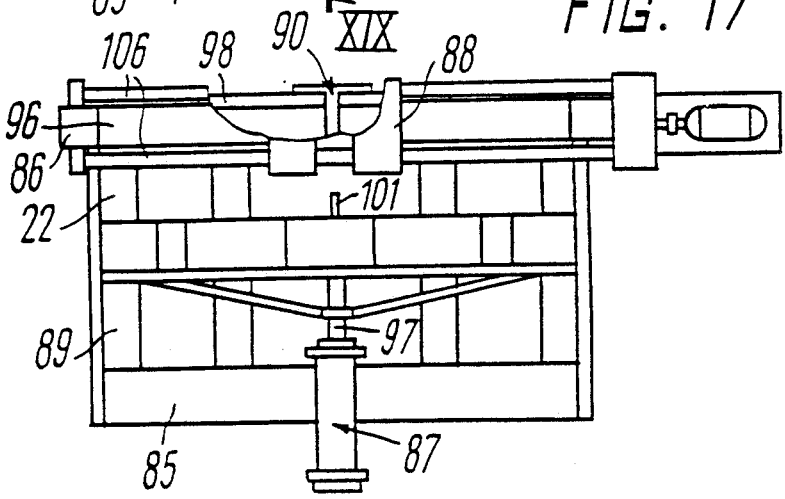
FIG. 18 is ditto of FIG. 17, a plan view.

An apparatus for carrying out the method according to the invention illustrated in FIG. 2 comprises a bed 85 (FIG. 17) having uprights 86, the sizing former 22, the non-driven rolls 23, a means 87 (FIG. 18) for feeding the former 22 carrying the billet 1 to the rolls, a pair of driven carriages 88 supporting the non-driven rolls 23 (FIG. 17), guides 89 and a means 90 for pressing the billet 1 against the former 22. The non-driven rolls 23 of the carriage 88 form the forming unit 25.

The sizing former 22 has the groove 21 of a length and shape corresponding to the length and shape of a product obtained after rolling of the billet 1. The former 22 has shoulders 91 and 92 (FIG. 19) extending along the groove 21, and the rolls 23 are positioned between these shoulders during rolling. The rolls 23 cylindrical and are mounted on a pivot pin 93 for rotation during their movement by the carriages 88 when they engage the billet 1.

The driven carriages 88 (the number of which may exceed two and the number of which is determined by the amount of maximum reduction, i.e. difference between thicknesses of the profile of the finished product at the middle portion 3 and at the end portions 4,5) are moved along the longitudinal axis of the former 22 in the opposite directions, and each of the carriages is in the form of a cast casing of rectangular section having a recess 95 in the bottom part thereof for receiving the roll 23 and a square opening in the top part for receiving a beam 96 mounted on the uprights 86 for guiding the carriages 88, the beam being designed for preventing the carriages 88 supporting the rolls 23 from elastically recoiling during rolling.

The means 87 (FIG. 18) for feeding the sizing former 22 carrying the billet 1 to the rolls 23 is in the form of hydrualic cylinder having its piston rod 97 connected to the former, the cylinder being rigidly secured in the bed 85.

Figure 19:
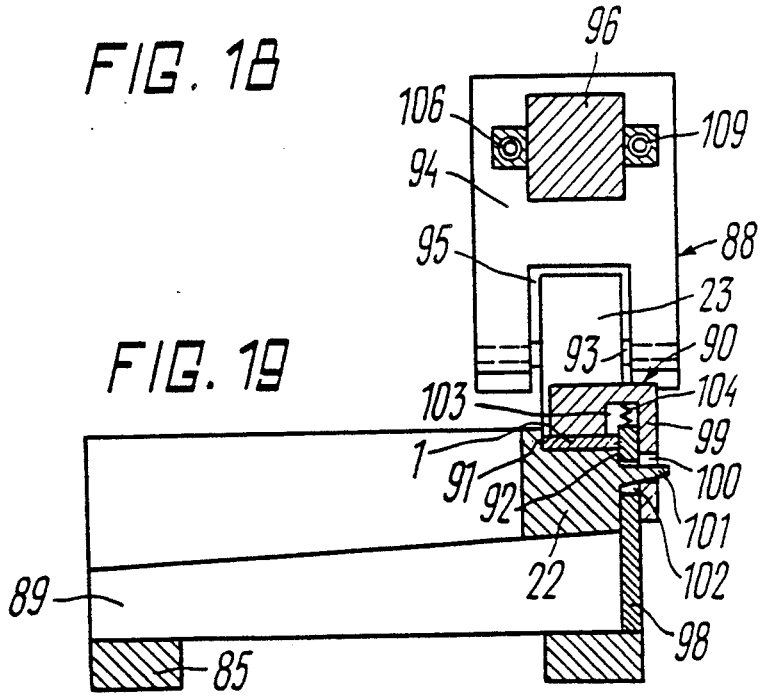
FIG. 19 is a sectional view taken along line XIX—XIX in FIG. 17.

The guides 89 (FIG. 19) supporting the sizing former 22 are designed for movement of the former perpendicularly with respect to the rolling path. This is achieved by the fact that the sizing former 22 and the guides 89 are in the form of pairs of wedges having identical angles of pitch and the vertexes facing in the opposite directions as shown in FIG. 19.

The means 90 for pressing the billet 1 against the sizing the former 22 is mounted on an abutment plate 98 provided at the ends of the guides 89 (FIG. 18) on the side opposite with respect to the means 87 for driving the sizing former 22. The means 90 is mounted for vertical movement in parallel with the abutment plate 98 and comprises a spring-biased bracket 99 having an opening 100 and a wedge-shaped pushrod 101 which is provided on the end face of the sizing former 22.

The abutment plate 98 has an opening 102 opposite to the pushrod 101. A spring 104 is provided between the support plate 98 and a slot 103 of the bracket 99 to press the bracket 99 upwards away from the plate 98.

The top part of the support plate 98 received in the slot 103 of the bracket 99 functions as the shoulder 92 of the former 22. As a result of this design of the shoulder 92, the former 22 is adjacent thereto, or spaced apart therefrom during movement so as to facilitate placing of the billet into the groove of the former and removal of the finished product from the former 22.

For moving the carriages 88 (FIG. 17) in the opposite directions, a common drive is used which comprises an electric motor 105 screw pairs having their screws 106 connected to the electric motor 105 by means of a reduction gear 107 and journalled in bearings 108 of the uprights 86 to run in parallel with the longitudinal axis of the former, the nuts being provided in the casing 94 of the carriages 88 (not shown). Each of the screws 106 has two equal portions with righthand and lefthand thread.

To avoid longitudinal bending of the screws 106 during rolling under the action of thrust forces, the screws 106 have auxiliary bearings provided on the beam 96 in their intermediate portion.

The apparatus functions in the following manner.

The billet 1 heated to the rolling temperature is placed in the groove 21 of the sizing former 22 and is pressed against the former 22 at the horizontal portion of the groove 21. The former 22 carrying the billet 1 is then caused by the means 87 to move to the deformation zone until the billet 1 comes in engagement with the rolls 23 and the former 22 bears against the abutment plate 98. During movement of the former 22 carrying the billet 1 to the deformation zone, the wedge-shaped pushrod 101 provided on the end face of the former 22 passes through the opening 102 (FIG. 19) of the abutment plate 98 to engage with its wedge face the inner surface of the opening 100 of the bracket 99 to move the latter until it bears against the billet 1 placed in the groove of the former 22. Subsequently the screws 106 actuated by the electric motor 105 and reduction gear 107 cooperate with the nuts of the carriages 88 to move them along the axis of the former in the mutually opposite directions with respect to each other from the middle portion 3 of the billet towards the ends 4 and 5 thereof and roll the billet 1 by the rolls 23 to obtain the desired profile. Then the means 87 retracts the former 22 carrying the reduced billet to the initial position. During movement of the former 22 carrying the billet in the reversed direction, the wedge-shaped pushrod 101 leaves the opening 100 of the bracket 99 which releases the billet under the action of the spring 104 and moves the bracket 94 back of the initial position. The rolled billet is then removed from the groove 21 of the former 22, a new billet is placed, and the abovedescribed cycle is repeated.

Therefore, the use of the method and apparatus according to the invention makes it possible to carry out piecemeal rolling of blanks for few-leaf springs of preset dimensions having identical operation characteristics of both runs with a shorter forming time.

Industrial Applicability

Method and apparatus of the present invention may be most advantageously used for making blanks of few-leaf springs for automobile vehicles, railway vehicles and tractors.

What is claimed is:

1. A method for making blanks of a profile varying lengthwise, comprising heating a billet (1), placing said billet on a sizing former (2), feeding the former (2) carrying the billet (1) into a deformation zone for forming a product of desired profile, deforming the heated billet (1) on the sizing former (2) from a middle portion (3) of the billet simultaneously toward both ends (4 and 5) thereof, removing the deformed billet (1) from the former (2) and straightening the billet (1) to give the billet (1) the desired shape.

2. A method as claimed in claim 1 wherein the step of deforming the heated billet (1) is carried out on the sizing former (2) in the same direction by the process comprising advancing the former (2) carrying the billet (1) at the middle portion (3) thereof through a groove (6) of a constant size, said former (2) having sizing faces (7) on either side thereof and being symmetrical with respect to the longitudinal axis of the former (2), each sizing face having a length corresponding to the length of the product from its middle portion (3) to the ends (4 and 5).

3. A method as claimed in claim 2, characterized in that deformation of heated billet (1) on the sizing former (2) is carried out by rolling with at least one pair of non-driven rolls (10) said heated billet being put astride the former (2) before feeding the sizing former to said deformation zone in such a manner that the middle portion (3) of the billet is positioned opposite to the groove of the rolls (10), the rolls (10) rolling over the bent billet (1) during rolling to form its runs to conform to the shape of the sizing face of the former (2), the billet removed from the former after rolling being unbent to impart the desired shape thereto.

4. A method as claimed in claim 3, characterized in that said rolling is carried out with stepwise deformation with small individual reductions.

5. A method as claimed in claim 2, characterized in that said deformation of the billet (1) on the sizing former (2) is carried out by drawing through a die (17), said heated billet (1) being put astride the former (2) when feeding said sizing former to the deformation zone in such a manner that the middle portion (3) of the billet (1) is positioned opposite to an aperture (18) of the die (17) the working faces (20) of the die engaging the bent billet (1) during said drawing to form its runs to conform to the shape of the sizing face of the former, the billet removed from the former after the drawing being unbent to impart a preset shape thereto.

6. A method as claimed in claim 17, characterized in that said deformation of the heated billet from its middle portion (3) towards the ends (4,5) thereof is carried out simultaneously in the mutually opposite directions by rolling on a stationary former (22) by means of at least two non-driven rolls (23) which are caused to move along the former (22) in the mutually opposite directions for forming runs of the billet between its middle portion end and the ends thereof.

7. An apparatus for making blanks of a profile varying lengthwise comprising a bed (24), a sizing former (2), a planetary rolling mill (25), a means (26) for feeding the sizing former to said planetary rolling mill (25) wherein said planetary rolling mill (25) comprises work rolls (15), and rims (16) mounted for free rotation in cages of support rolls (14), said planetary rolling mill being fixedly mounted on the bed (24) and having a groove (6) of a constant size, said sizing former (2) being positioned coaxially with the groove (6) and having sizing faces (7) being in the form of concave surfaces (13), the center of each curve (13), taking into account the varying thickness of the profile of a billet (1) being formed, being located on the axis of rotation of a respective support roll (14), said sizing faces (7) being on either side of the groove (6) and being symmetrical with respect to the longitudinal axis of the sizing former (2), each sizing face (7) having a length corresponding to the length of the product between its middle portion and the end thereof, a pair of guide rollers (12) provided between said sizing former (2) and the planetary rolling mill (25) for guiding the billet (1), the guide rollers being positioned symmetrically with respect to the longitudinal axis of said sizing former, a limiting abutment (29) provided on the bed (24) and spaced from the longitudinal axis of the sizing former at a distance equal to one half of the billet length.

8. An apparatus for making blanks of a profile varying lengthwise comprising a bed (24), a sizing former (2), a die (25), a means (26) for feeding said sizing former to said die (25) wherein said die (25) comprises an aperture (18) having an I-section configuration with grooves (57) receiving pressure bars (58) engageable with shoulders of the grooves (57), said die (25) being fixedly mounted on the bed (24) and having a groove (6) of a constant size, said sizing former (2) being positioned coaxially with the groove (6) and having sizing faces on either side thereof and being symmetrical with respect to the longitudinal axis of the sizing former, each sizing face having a length corresponding to the length of the product between its middle portion and end thereof, a pair of guide rollers (12) provided between said sizing former (2) and the die (25) for guiding the billet (1), the guide rollers being positioned symmetrically with respect to the longitudinal axis of said sizing former, a limiting abutment (29) provided on said bed (24) and spaced from the longitudinal axis of the sizing former at a distance equal to one half of the billet length.

9. An apparatus for making blanks of a profile varying lengthwise comprising a bed (24), a sizing former (2), a forming unit (25), and a means (26) for feeding the sizing former to said forming unit (25), said apparatus comprising a plurality of sizing formers (2) having shoulders, a means (70) for feeding the sizing formers to the forming unit (25) comprising a revolving face plate (72) supporting said formers (2) mounted in series, wherein said forming unit (25) is fixedly mounted on the bed (24) and has a groove (6) of a constant size, said sizing formers (2) being positioned coaxially with the groove (6) and having sizing faces (7) being in the form of curves (80) and positioned on either side of the groove (6) and being symmetrical with respect to the longitudinal axis of the sizing formers, each sizing face having a length corresponding to the length of the product between its middle portion and the end thereof, said forming unit (25) having a rolling stand with vertical non-driven rolls (77) having their axes running in parallel with the axis of rotation of the face plate (72) and located on concentrical circles having their center coinciding with the center of rotation of the face plate (72), said apparatus further comprising a pair of guide rollers (12) provided between said sizing formers (2) and the forming unit (25) for guiding the billet (1), the guide rollers being positioned symmetrically with respect to the longitudinal axis of the sizing formers, the limiting abutment (29) provided on said bed (24) and spaced from the longitudinal axis of the sizing formers at a distance equal to one half of the billet length.

10. An apparatus for making blanks of a profile varying lengthwise comprising a bed (24), a sizing former (2), a forming unit (25), and a means (26) for feeding the sizing former to said forming unit (25) wherein said forming unit (25) is fixedly mounted on the bed (24) and has a groove (6) of a constant size, said sizing former (2) being positioned coaxially with the groove (6) and having sizing faces (7) on either side thereof and being symmetrical with respect to the longitudinal axis of the sizing former, each sizing face having a length corresponding to the length of the product between its middle portion and the end thereof, a pair of guide rollers (12) provided between said sizing former (2) and the forming unit (25) for guiding the billet (1), the guide rollers being positioned symmetrically with respect to the longitudinal axis of the sizing former, a limiting abutment (29) provided on said bed (24) and spaced from the longitudinal axis of the sizing former at a distance equal to one half of the billet length, and means (28) for unbending a removed billet, comprising means (38) for clamping the middle portion of the billet and a pair of movable power actuators (39) engageable with the runs of the bent billet (1).

11. An apparatus for making blanks of a profile varying lengthwise comprising a bed (85), a sizing former (22), a forming unit (25) and a means for feeding the sizing former (22) carrying a billet to said forming unit (25) wherein said sizing former (22) has shoulders (91,92) defining a groove (21) for the billet, the length of which corresponds to the length of the finished product, said forming unit (25) comprising non-driven rolls (23) and at least two driven carriages (88), having a common drive and comprising an electric motor (105) and screw pairs, having screws (106) connected to the electric motor (105) through a reduction gear (107) and journalled in bearings of uprights (86) of said bed to extend in parallel with the longitudinal axis of the sizing former (22), wherein each of the screws (106) has equal portions with right hand and left hand threads, said carriages (88) supporting said rolls (23) and being movable along the axis of the sizing former (22) in the mutually opposite direction from the middle portion of the sizing former (22).

12. An apparatus for making blanks of a profile varying lengthwise comprising a bed (85), a sizing former (22), a forming unit (25), means for feeding the sizing former carrying the billet to said forming unit wherein the sizing former (22) has shoulders (91, 92) defining a groove (21) for the billet the length of which corresponds to the length of the finished product, said forming unit (25) comprising non-driven rolls (23) and at least two driven carriages (88) supporting said rolls (23) and movable along the axis of the sizing former (22) in the mutually opposite direction from the middle portion of the former (22), said apparatus further comprising guides (89), said sizing former (22) being mounted on said guides (89) for movement perpendicular to the rolling path, said guides (89) forming in combination with the sizing former (22) pairs of wedges having identical angles of pitch and the vertexes facing in the opposite directions, an abutment plate (98) being provided at the ends of said guides (89) on the side opposite to said means for feeding the sizing former, the abutment plate (98) having a means (90) for pressing the billet against the sizing former (22) while functioning as one of the shoulders thereof.

13. An apparatus as claimed in claim 12, characterized in that said means (90) for pressing the billet against the sizing former (22) is made in the form of a spring-biased bracket/(99) mounted on said abutment plate (98) for vertical movement in parallel with the abutment plate (98), and a wedge-shaped pushrod (101) provided on the end face of said sizing former (22), said abutment plate (98) and spring-biased having openings (102,100), said pushrod (101) passing through said openings (102,100) to engage with its wedge-shaped face the spring-biased bracket/(99) and move said bracket.

* * * * *